US007530127B2

(12) United States Patent
Leifermann et al.

(10) Patent No.: US 7,530,127 B2
(45) Date of Patent: May 12, 2009

(54) PILLOW AND METHOD OF MANUFACTURING A PILLOW

(75) Inventors: Bente Leifermann, Odense (DK); Trine Thrane, Odense (DK); Torben Mikkelsen, Kolding (DK)

(73) Assignee: Dan-Foam ApS, Aarup (DK)

( * ) Notice: Subject to any disclaimer, the term of this patent is extended or adjusted under 35 U.S.C. 154(b) by 0 days.

(21) Appl. No.: 11/407,432

(22) Filed: Apr. 20, 2006

(65) Prior Publication Data

US 2007/0044239 A1 Mar. 1, 2007

(51) Int. Cl.
*A47G 9/10* (2006.01)

(52) U.S. Cl. ..... 5/636; 5/490; 5/655.9; 5/953; 5/638

(58) Field of Classification Search ..... 5/636, 5/644, 645, 490, 655.9, 953, 654, 655.4, 5/911, 638
See application file for complete search history.

(56) References Cited

U.S. PATENT DOCUMENTS

| | | | |
|---|---|---|---|
| D28,903 | S | 6/1898 | Amory |
| 1,312,886 | A | 8/1919 | Bawden |
| 1,382,831 | A | 6/1921 | Hiker |
| D59,900 | S | 12/1921 | Marsh |
| 1,742,186 | A | 1/1930 | Claus |
| 1,876,591 | A | 9/1932 | Bawden |
| D94,702 | S | 2/1935 | Marks |
| 2,013,481 | A | 9/1935 | Stonehill |
| 2,056,767 | A | 10/1936 | Blath |
| 2,149,140 | A | 2/1939 | González-Rincones |
| 2,167,622 | A | 8/1939 | Bentivoglio |
| D126,825 | S | 4/1941 | Kolisch |
| 2,295,906 | A | 9/1942 | Lacour |
| 2,298,218 | A | 10/1942 | Madson |
| 2,522,120 | A | 9/1950 | Kaskey |
| 2,552,476 | A | 5/1951 | Barton |
| 2,700,779 | A | 2/1955 | Tolkowsky |
| 2,724,133 | A | 11/1955 | Sorrell |
| 2,759,200 | A | 8/1956 | Johnston |

(Continued)

FOREIGN PATENT DOCUMENTS

DE 1654301 11/1971

(Continued)

OTHER PUBLICATIONS

"Leg Cushion," OrthoSupport™ *Sleep Buddy*, http://www.orthosupport.com/sleep_buddy.htm, OrthoSupport International Co, 2000, 2 pages.

(Continued)

*Primary Examiner*—Robert G Santos
(74) *Attorney, Agent, or Firm*—Michael Best & Friedrich LLP

(57) ABSTRACT

Some embodiments of the disclosed pillows have a sleeve of viscoelastic material within which is received and enclosed a plurality of loose pieces of filler material. The sleeve can have one or more openings shaped and dimensioned to provide ventilation for the interior of the pillow and/or to enable a user to insert and remove an inner sleeve within which the filler material is retained. In some embodiments, the inner sleeve has two or more compartments for holding the same or different filler materials having the same or different densities, thereby providing a pillow adapted for different uses and support characteristics.

12 Claims, 7 Drawing Sheets

U.S. PATENT DOCUMENTS

| | | | | |
|---|---|---|---|---|
| 2,765,480 | A | | 10/1956 | Mueller |
| 2,835,905 | A | | 5/1958 | Tomasson |
| 2,880,428 | A | | 4/1959 | Forsland |
| 2,898,975 | A | | 8/1959 | Wagner |
| 3,000,020 | A | | 9/1961 | Lombard et al. |
| 3,047,517 | A | | 7/1962 | Wherley |
| 3,047,888 | A | | 11/1962 | Shecter et al. |
| 3,124,812 | A | * | 3/1964 | Milton et al. ..... 5/638 |
| 3,148,389 | A | | 9/1964 | Lustig |
| 3,287,750 | A | | 11/1966 | Jessup |
| 3,327,330 | A | | 6/1967 | McCullough |
| D211,244 | S | | 6/1968 | Hawley |
| 3,400,413 | A | | 9/1968 | La Grossa |
| 3,469,882 | A | | 9/1969 | Larsen |
| 3,574,397 | A | | 4/1971 | Norriss |
| 3,604,023 | A | | 9/1971 | Lynch |
| 3,606,461 | A | | 9/1971 | Moriyama |
| 3,637,458 | A | | 1/1972 | Parrish |
| 3,757,365 | A | | 9/1973 | Kretchmer |
| D230,804 | S | | 3/1974 | Lijewski |
| 3,795,018 | A | | 3/1974 | Broaded |
| 3,829,917 | A | | 8/1974 | De Laittre et al. |
| 3,833,259 | A | | 9/1974 | Pershing |
| 3,837,021 | A | | 9/1974 | Sellers et al. |
| 3,870,662 | A | | 3/1975 | Lundberg |
| 3,896,062 | A | | 7/1975 | Morehouse |
| 3,906,137 | A | | 9/1975 | Bauer |
| D238,235 | S | | 12/1975 | Elgebrandt |
| 3,939,508 | A | | 2/1976 | Hall et al. |
| 3,987,507 | A | | 10/1976 | Hall |
| 4,007,503 | A | | 2/1977 | Watkin |
| 4,027,888 | A | | 6/1977 | Wilcox |
| 4,060,863 | A | | 12/1977 | Craig |
| 4,065,150 | A | | 12/1977 | Van Auken |
| D247,312 | S | | 2/1978 | Zeiss |
| 4,086,675 | A | | 5/1978 | Talbert et al. |
| 4,118,813 | A | | 10/1978 | Armstrong |
| 4,173,048 | A | | 11/1979 | Varaney |
| 4,177,806 | A | | 12/1979 | Griffin |
| 4,185,673 | A | | 1/1980 | Daniello |
| 4,190,697 | A | | 2/1980 | Ahrens |
| 4,218,792 | A | | 8/1980 | Kogan |
| D258,557 | S | | 3/1981 | Herr |
| D258,793 | S | | 4/1981 | Rinz |
| D259,381 | S | | 6/1981 | Smith |
| D260,125 | S | | 8/1981 | Rogers |
| 4,374,172 | A | | 2/1983 | Schwarz et al. |
| 4,379,856 | A | | 4/1983 | Samaritter et al. |
| 4,454,309 | A | | 6/1984 | Gould et al. |
| 4,480,346 | A | | 11/1984 | Hawkins et al. |
| 4,496,535 | A | | 1/1985 | Gould et al. |
| D278,779 | S | | 5/1985 | Sink |
| D279,642 | S | | 7/1985 | Ross |
| D282,427 | S | | 2/1986 | O'Sullivan |
| 4,571,761 | A | | 2/1986 | Perlin |
| 4,580,301 | A | | 4/1986 | Ludman et al. |
| 4,584,730 | A | | 4/1986 | Rajan |
| D284,724 | S | | 7/1986 | Clark et al. |
| 4,606,088 | A | | 8/1986 | Michaelsen et al. |
| 4,624,021 | A | | 11/1986 | Hofstetter |
| 4,698,864 | A | | 10/1987 | Graebe |
| 4,736,477 | A | | 4/1988 | Moore |
| 4,748,768 | A | | 6/1988 | Jacobsen |
| 4,754,510 | A | | 7/1988 | King |
| 4,755,411 | A | | 7/1988 | Wing et al. |
| 4,759,089 | A | | 7/1988 | Fox |
| 4,773,107 | A | | 9/1988 | Josefek |
| 4,773,142 | A | | 9/1988 | Davis et al. |
| D298,198 | S | | 10/1988 | O'Sullivan |
| 4,777,855 | A | | 10/1988 | Cohen |
| 4,788,728 | A | | 12/1988 | Lake |
| 4,799,275 | A | | 1/1989 | Sprague, Jr. |
| 4,808,469 | A | | 2/1989 | Hiles |
| 4,810,685 | A | | 3/1989 | Twigg et al. |
| 4,821,355 | A | | 4/1989 | Burkhardt |
| 4,826,882 | A | | 5/1989 | Bredbenner et al. |
| 4,832,007 | A | | 5/1989 | Davis, Jr. et al. |
| 4,840,430 | A | | 6/1989 | Shimada |
| 4,842,330 | A | | 6/1989 | Jay |
| 4,843,662 | A | | 7/1989 | Handelman |
| D302,592 | S | | 8/1989 | Holmes |
| 4,862,539 | A | | 9/1989 | Bokich |
| 4,863,712 | A | | 9/1989 | Twigg et al. |
| 4,864,669 | A | | 9/1989 | Jones |
| D303,897 | S | | 10/1989 | Phillips |
| D305,084 | S | | 12/1989 | Gyebnar |
| D306,245 | S | | 2/1990 | Akhtarekhavari |
| 4,899,405 | A | | 2/1990 | Rothbard |
| 4,908,893 | A | | 3/1990 | Smit |
| 4,910,818 | A | | 3/1990 | Grabill et al. |
| 4,916,765 | A | | 4/1990 | Castronovo, Jr. |
| D308,311 | S | | 6/1990 | Forsland |
| D308,787 | S | | 6/1990 | Youngblood |
| D309,689 | S | | 8/1990 | Bool |
| 4,950,694 | A | | 8/1990 | Hager |
| 4,959,880 | A | | 10/1990 | Tesch |
| D314,116 | S | | 1/1991 | Reed |
| 4,987,156 | A | | 1/1991 | Tozune et al. |
| 5,006,569 | A | | 4/1991 | Stone |
| 5,010,610 | A | | 4/1991 | Ackley |
| 5,018,231 | A | | 5/1991 | Wang |
| 5,018,790 | A | | 5/1991 | Jay |
| 5,019,602 | A | | 5/1991 | Lowe |
| 5,031,261 | A | | 7/1991 | Fenner, Sr. |
| D319,751 | S | | 9/1991 | Hoff |
| 5,049,591 | A | | 9/1991 | Hayashi et al. |
| D320,715 | S | | 10/1991 | Magnin et al. |
| 5,054,143 | A | | 10/1991 | Javaher |
| 5,061,737 | A | | 10/1991 | Hudson |
| D321,562 | S | | 11/1991 | Ljungvall |
| 5,088,141 | A | | 2/1992 | Meyer et al. |
| D325,839 | S | | 5/1992 | Main |
| 5,114,989 | A | | 5/1992 | Elwell et al. |
| 5,117,522 | A | | 6/1992 | Everett |
| 5,121,515 | A | | 6/1992 | Hudson |
| 5,123,133 | A | | 6/1992 | Albert |
| 5,125,123 | A | | 6/1992 | Engle |
| 5,138,732 | A | | 8/1992 | Wattie et al. |
| 5,148,564 | A | | 9/1992 | Reder |
| D333,938 | S | | 3/1993 | Watson et al. |
| D334,318 | S | | 3/1993 | Chee |
| 5,189,747 | A | | 3/1993 | Mundy et al. |
| D336,809 | S | | 6/1993 | Emery |
| 5,216,771 | A | | 6/1993 | Hoff |
| 5,219,893 | A | | 6/1993 | Konig et al. |
| 5,228,158 | A | * | 7/1993 | Park ..... 5/636 |
| 5,230,947 | A | | 7/1993 | Ou |
| D341,509 | S | | 11/1993 | Evans |
| 5,265,295 | A | | 11/1993 | Sturgis |
| D342,411 | S | | 12/1993 | Graebe |
| 5,294,181 | A | | 3/1994 | Rose et al. |
| 5,317,773 | A | | 6/1994 | Graebe |
| 5,367,731 | A | | 11/1994 | O'Sullivan |
| D354,356 | S | | 1/1995 | Shiflett |
| D354,876 | S | | 1/1995 | Pace |
| 5,382,602 | A | | 1/1995 | Duffy et al. |
| 5,418,991 | A | | 5/1995 | Shiflett |
| D358,957 | S | | 6/1995 | Propp |
| D359,870 | S | | 7/1995 | McLaughlin |
| 5,437,070 | A | | 8/1995 | Rempp |
| 5,457,832 | A | | 10/1995 | Tatum |
| 5,482,980 | A | | 1/1996 | Pcolinsky |
| D367,199 | S | | 2/1996 | Graebe |
| D367,390 | S | | 2/1996 | Johnston et al. |

D369,663 S 5/1996 Gostine
5,522,106 A 6/1996 Harrison et al.
5,523,144 A 6/1996 Dyer, Jr.
5,528,784 A 6/1996 Painter
5,530,980 A 7/1996 Sommerhalter, Jr.
5,537,703 A * 7/1996 Launder et al. ..... 5/636
5,544,377 A 8/1996 Gostine
D374,146 S 10/1996 Bonaddio et al.
5,567,740 A 10/1996 Free
5,572,757 A 11/1996 O'Sullivan
D377,575 S 1/1997 Lowrey, Jr. et al.
5,591,780 A 1/1997 Muha et al.
5,638,564 A 6/1997 Greenawalt et al.
5,644,809 A 7/1997 Olson
D381,855 S 8/1997 Galick
D382,163 S 8/1997 Hartney
D383,026 S 9/1997 Torbik
5,664,271 A 9/1997 Ballavance
5,669,094 A 9/1997 Swanson
5,682,633 A 11/1997 Davis
5,687,436 A 11/1997 Denton
D387,235 S 12/1997 Carpenter
D388,648 S 1/1998 Bates
D388,649 S 1/1998 Chekuri
D388,650 S 1/1998 Davis
5,708,998 A 1/1998 Torbik
D390,405 S 2/1998 Jung
D391,112 S 2/1998 Houston
5,724,685 A 3/1998 Weismiller et al.
D393,564 S 4/1998 Liu
5,746,218 A 5/1998 Edge
D394,977 S 6/1998 Frydman
D395,568 S 6/1998 Davis
5,778,470 A * 7/1998 Haider ..... 5/645
5,781,947 A 7/1998 Sramek
D397,270 S 8/1998 Maalouf
5,797,154 A 8/1998 Contreras
D399,675 S 10/1998 Ferris
D402,150 S 12/1998 Wurmbrand et al.
5,848,448 A 12/1998 Boyd
D404,237 S 1/1999 Boyd
5,855,415 A 1/1999 Lilley, Jr.
5,884,351 A 3/1999 Tonino
D409,038 S 5/1999 Rojas, Jr. et al.
D410,810 S 6/1999 Lozier
D412,259 S 7/1999 Wilcox et al.
5,926,880 A 7/1999 Sramek
D415,920 S 11/1999 Denney
D416,742 S 11/1999 Sramek
D417,579 S 12/1999 Tarquinio
D417,997 S 12/1999 Yannakis
6,003,177 A 12/1999 Ferris
D418,711 S 1/2000 Mettler
6,017,601 A 1/2000 Amsel
6,018,831 A 2/2000 Loomos
6,034,149 A 3/2000 Bleys et al.
6,047,419 A 4/2000 Ferguson
6,049,927 A 4/2000 Thomas et al.
6,052,851 A 4/2000 Kohnle
6,079,066 A 6/2000 Backlund
6,093,468 A 7/2000 Toms et al.
D428,716 S 8/2000 Larger
D429,106 S 8/2000 Bortolotto et al.
6,115,861 A 9/2000 Reeder et al.
6,136,879 A 10/2000 Nishida et al.
D434,936 S 12/2000 May
6,154,905 A 12/2000 Frydman
6,156,842 A 12/2000 Hoenig et al.
6,159,574 A 12/2000 Landvik et al.
6,161,238 A 12/2000 Graebe
6,171,532 B1 1/2001 Sterzel
6,182,311 B1 2/2001 Buchanan et al.
6,182,312 B1 2/2001 Walpin
6,182,314 B1 2/2001 Frydman
D439,099 S 3/2001 Erickson
6,202,232 B1 3/2001 Andrei
6,202,239 B1 3/2001 Ward et al.
6,204,300 B1 3/2001 Kageoka et al.
6,226,818 B1 5/2001 Rudick
6,237,173 B1 5/2001 Schlichter et al.
6,241,320 B1 6/2001 Chew et al.
6,245,824 B1 6/2001 Frey et al.
D445,505 S 7/2001 Shapiro
6,253,400 B1 7/2001 Rüdt-Sturzenegger et al.
6,254,189 B1 7/2001 Closson
D446,305 S 8/2001 Buchanan et al.
6,292,964 B1 9/2001 Rose et al.
6,317,908 B1 11/2001 Walpin
6,321,402 B1 11/2001 Ming-Chung
6,327,725 B1 12/2001 Veilleux et al.
6,345,401 B1 2/2002 Frydman
6,347,421 B1 2/2002 D'Emilio
D455,311 S 4/2002 Fux
6,367,106 B1 4/2002 Gronsman
6,391,933 B1 5/2002 Mattesky
6,391,935 B1 5/2002 Hager et al.
6,401,283 B2 6/2002 Thomas et al.
6,408,467 B2 6/2002 Walpin
6,412,127 B1 7/2002 Cuddy
D463,701 S 10/2002 Borcherding et al.
6,471,726 B2 10/2002 Wang
D465,686 S 11/2002 Hwong
D466,750 S 12/2002 Landvik
D466,751 S 12/2002 Coats et al.
6,490,743 B1 12/2002 Adat et al.
6,491,846 B1 12/2002 Reese, II et al.
6,513,179 B1 2/2003 Pan
D471,750 S 3/2003 Jamvold et al.
6,541,094 B1 4/2003 Landvik et al.
D474,364 S 5/2003 Arcieri
D474,637 S 5/2003 Scheetz
6,574,809 B1 6/2003 Rathbun
6,578,220 B1 6/2003 Smith
6,583,194 B2 6/2003 Sendijarevic
6,594,838 B1 7/2003 Hollander et al.
6,602,579 B2 8/2003 Landvik
6,617,014 B1 9/2003 Thomson
6,617,369 B2 9/2003 Parfondry et al.
6,625,829 B2 9/2003 Zell
6,634,045 B1 10/2003 DuDonis et al.
6,635,688 B2 10/2003 Simpson
6,653,362 B2 11/2003 Toyota et al.
6,653,363 B1 11/2003 Tursi, Jr. et al.
6,663,537 B2 12/2003 McCoy
6,671,907 B1 1/2004 Zuberi
6,687,933 B2 2/2004 Habboub et al.
6,699,917 B2 3/2004 Takashima
6,701,558 B2 3/2004 VanSteenburg
D489,749 S 5/2004 Landvik
6,733,074 B2 5/2004 Groth
6,734,220 B2 5/2004 Niederoest et al.
6,742,207 B1 6/2004 Brown
6,751,818 B2 6/2004 Troop
6,756,415 B2 6/2004 Kimura et al.
6,779,211 B1 8/2004 Williams
D496,205 S 9/2004 Baddour
6,810,541 B1 11/2004 Woods
6,813,790 B2 11/2004 Flick et al.
6,845,534 B1 1/2005 Huang
6,848,128 B2 2/2005 Verbovszky et al.
6,857,151 B2 2/2005 Jusiak et al.
6,866,915 B2 3/2005 Landvik
6,872,758 B2 3/2005 Simpson et al.
D504,269 S 4/2005 Faircloth
6,877,176 B2 4/2005 Houghteling
6,915,539 B2 7/2005 Rathbun

| | | | | |
|---|---|---|---|---|
| 6,928,677 | B1 | 8/2005 | Pittman | |
| 6,966,090 | B2 | 11/2005 | McClintock et al. | |
| 7,051,389 | B2 * | 5/2006 | Wassilefky | 5/636 |
| 7,059,001 | B2 | 6/2006 | Woolfson | |
| D529,325 | S | 10/2006 | Maarbjerg | |
| 7,255,917 | B2 | 8/2007 | Rochlin et al. | |
| D558,499 | S | 1/2008 | Maarbjerg | |
| 7,415,742 | B2 | 8/2008 | Wassilefsky | |
| 2001/0000829 | A1 | 5/2001 | Thomas et al. | |
| 2001/0003219 | A1 | 6/2001 | Chou | |
| 2001/0018777 | A1 | 9/2001 | Walpin | |
| 2001/0027577 | A1 | 10/2001 | Frydman | |
| 2001/0032365 | A1 | 10/2001 | Sramek | |
| 2001/0054200 | A1 | 12/2001 | Romano et al. | |
| 2002/0018884 | A1 | 2/2002 | Thomson | |
| 2002/0019654 | A1 | 2/2002 | Ellis et al. | |
| 2002/0028325 | A1 | 3/2002 | Simpson | |
| 2002/0043736 | A1 | 4/2002 | Murakami et al. | |
| 2002/0088057 | A1 | 7/2002 | Wassilefsky | |
| 2002/0099106 | A1 | 7/2002 | Sendijarevic | |
| 2002/0112287 | A1 | 8/2002 | Thomas et al. | |
| 2002/0122929 | A1 | 9/2002 | Simpson et al. | |
| 2002/0124318 | A1 | 9/2002 | Loomos | |
| 2002/0128420 | A1 | 9/2002 | Simpson et al. | |
| 2003/0005521 | A1 | 1/2003 | Sramek | |
| 2003/0014820 | A1 | 1/2003 | Fuhriman | |
| 2003/0037376 | A1 | 2/2003 | Zell | |
| 2003/0045595 | A1 | 3/2003 | Toyota et al. | |
| 2003/0065046 | A1 | 4/2003 | Hamilton | |
| 2003/0087979 | A1 | 5/2003 | Bleys et al. | |
| 2003/0105177 | A1 | 6/2003 | Parfondry et al. | |
| 2003/0124337 | A1 | 7/2003 | Price et al. | |
| 2003/0131419 | A1 | 7/2003 | VanSteenburg | |
| 2003/0145384 | A1 | 8/2003 | Stelnicki | |
| 2003/0150061 | A1 | 8/2003 | Farley | |
| 2003/0182727 | A1 | 10/2003 | DuDonis et al. | |
| 2003/0186044 | A1 | 10/2003 | Sauniere et al. | |
| 2003/0188383 | A1 | 10/2003 | Ense | |
| 2003/0188385 | A1 | 10/2003 | Rathbun | |
| 2003/0192119 | A1 | 10/2003 | Verbovszky et al. | |
| 2003/0200609 | A1 | 10/2003 | Jusiak et al. | |
| 2003/0218003 | A1 | 11/2003 | Ellis et al. | |
| 2003/0229154 | A1 | 12/2003 | Kemmler et al. | |
| 2004/0000804 | A1 | 1/2004 | Groth | |
| 2004/0019972 | A1 | 2/2004 | Schecter et al. | |
| 2004/0044091 | A1 | 3/2004 | Niederoest et al. | |
| 2004/0087675 | A1 | 5/2004 | Yu | |
| 2004/0097608 | A1 | 5/2004 | Re'em | |
| 2004/0112891 | A1 | 6/2004 | Ellis et al. | |
| 2004/0139548 | A1 | 7/2004 | Hwang-Pao | |
| 2004/0139550 | A1 | 7/2004 | Calagui | |
| 2004/0142619 | A1 | 7/2004 | Ueno et al. | |
| 2004/0155498 | A1 | 8/2004 | Verbovszky et al. | |
| 2004/0155515 | A1 | 8/2004 | Verbovszky et al. | |
| 2004/0164499 | A1 | 8/2004 | Murakami et al. | |
| 2004/0181003 | A1 | 9/2004 | Murakami et al. | |
| 2004/0226098 | A1 | 11/2004 | Pearce | |
| 2004/0229970 | A1 | 11/2004 | Sasaki et al. | |
| 2004/0266897 | A1 | 12/2004 | Apichatachutapan et al. | |
| 2004/0266900 | A1 | 12/2004 | Neff et al. | |
| 2005/0000022 | A1 | 1/2005 | Houghteling | |
| 2005/0005358 | A1 | 1/2005 | DuDonis | |
| 2005/0005362 | A1 | 1/2005 | Verbovszky et al. | |
| 2005/0022307 | A1 | 2/2005 | McClintock et al. | |
| 2005/0038133 | A1 | 2/2005 | Neff et al. | |
| 2005/0043423 | A1 | 2/2005 | Schmidt et al. | |
| 2005/0060807 | A1 | 3/2005 | Kaizuka | |
| 2005/0060809 | A1 | 3/2005 | Rogers | |
| 2005/0066445 | A1 | 3/2005 | Christofferson et al. | |
| 2005/0076442 | A1 * | 4/2005 | Wassilefky | 5/636 |
| 2005/0140199 | A1 | 6/2005 | Kang et al. | |
| 2006/0277684 | A1 * | 12/2006 | Wassilefky | 5/636 |
| 2007/0044239 | A1 * | 3/2007 | Leifermann et al. | 5/636 |
| 2007/0113347 | A1 * | 5/2007 | Lindell | 5/636 |
| 2007/0245493 | A1 * | 10/2007 | Leifermann et al. | 5/636 |
| 2008/0307581 | A1 * | 12/2008 | Wassilefky | 5/636 |

FOREIGN PATENT DOCUMENTS

| | | | |
|---|---|---|---|
| DE | 3321720 | | 12/1984 |
| DE | 3803448 | C | 8/1988 |
| DE | 4040156 | C | 6/1992 |
| DE | 10005919 | | 8/2001 |
| DE | 20207664 | U | 8/2002 |
| DE | 10237089 | | 2/2004 |
| DE | 202004003248 | | 5/2004 |
| DK | MR 1985 00079 | | 1/1985 |
| DK | MR 1985 00375 | | 5/1985 |
| EP | 0323742 | | 7/1989 |
| EP | 0361418 | B | 4/1990 |
| EP | 0365954 | B | 5/1990 |
| EP | 0433878 | B | 6/1991 |
| EP | 0486016 | | 5/1992 |
| EP | 0608626 | B | 8/1994 |
| EP | 0713900 | B | 5/1996 |
| EP | 0718144 | B | 6/1996 |
| EP | 0908478 | B | 4/1999 |
| EP | 0934962 | B | 8/1999 |
| EP | 0940621 | | 9/1999 |
| EP | 1021115 | | 7/2000 |
| EP | 1060859 | B | 12/2000 |
| EP | 1125719 | B | 8/2001 |
| EP | 1167019 | | 1/2002 |
| EP | 1184149 | B | 3/2002 |
| EP | 1188785 | | 3/2002 |
| EP | 1405867 | | 4/2004 |
| EP | 1507469 | | 2/2005 |
| FR | 2396648 | B | 2/1979 |
| FR | 2598910 | | 11/1987 |
| FR | 2795371 | B | 12/2000 |
| FR | 2818187 | B | 6/2002 |
| GB | 1273259 | | 3/1972 |
| GB | 2290256 | B | 12/1995 |
| GB | 2297057 | | 7/1996 |
| GB | 2314506 | | 1/1998 |
| GB | 2383958 | | 7/2003 |
| GB | 2414178 | | 11/2005 |
| IT | 1238272 | | 7/1993 |
| IT | 00224783 | | 6/1996 |
| JP | 52-106961 | | 9/1977 |
| JP | 62-183790 | | 12/1987 |
| JP | 3128006 | | 5/1991 |
| JP | H9-37909 | | 7/1995 |
| JP | 2002-306283 | | 10/2002 |
| KR | 10-2002-60116 | | 7/2002 |
| RU | 2145181 | | 10/2000 |
| SE | 457327 | C | 12/1988 |
| WO | WO 8504150 | | 9/1985 |
| WO | WO 8607528 | | 12/1986 |
| WO | WO 9208759 | | 5/1992 |
| WO | WO 9321806 | | 11/1993 |
| WO | WO 9401023 | | 1/1994 |
| WO | WO 9416935 | | 8/1994 |
| WO | WO 9518184 | | 7/1995 |
| WO | WO 9519755 | | 7/1995 |
| WO | WO 9520622 | | 8/1995 |
| WO | WO 9528861 | | 11/1995 |
| WO | WO 9529658 | | 11/1995 |
| WO | WO 9803333 | | 1/1998 |
| WO | WO 9804170 | | 2/1998 |
| WO | WO 9841126 | | 9/1998 |
| WO | WO 9845359 | | 10/1998 |
| WO | WO 9850251 | | 11/1998 |
| WO | WO 9902077 | | 1/1999 |
| WO | WO 9908571 | | 2/1999 |
| WO | WO 9915126 | | 4/1999 |

| | | |
|---|---|---|
| WO | WO 9944856 | 9/1999 |
| WO | WO 9952405 | 10/1999 |
| WO | WO 0017836 | 3/2000 |
| WO | WO 0062850 | 10/2000 |
| WO | WO 0105279 | 1/2001 |
| WO | WO 0116217 | 3/2001 |
| WO | WO 0125305 | 4/2001 |
| WO | WO 0128388 | 4/2001 |
| WO | WO 0132736 | 5/2001 |
| WO | WO 0143602 | 6/2001 |
| WO | WO 0147340 | 7/2001 |
| WO | WO 0156432 | 8/2001 |
| WO | WO 0157104 | 8/2001 |
| WO | WO 0170167 | 9/2001 |
| WO | WO 0179323 | 10/2001 |
| WO | WO 0200157 | 1/2002 |
| WO | WO 0246258 | 6/2002 |
| WO | WO 02051900 | 7/2002 |
| WO | WO 02051902 | 7/2002 |
| WO | WO 02062891 | 8/2002 |
| WO | WO 02077056 | 10/2002 |
| WO | WO 02088211 | 11/2002 |
| WO | WO 03000770 | 1/2003 |
| WO | WO 03046041 | 6/2003 |
| WO | WO 03054047 | 7/2003 |
| WO | WO 03066766 | 8/2003 |
| WO | WO 03070061 | 8/2003 |
| WO | WO 03072391 | 9/2003 |
| WO | WO 03099079 | 12/2003 |
| WO | WO 2004020496 | 3/2004 |
| WO | WO 2004034847 | 4/2004 |
| WO | WO 2004036794 | 4/2004 |
| WO | WO 2004039858 | 5/2004 |
| WO | WO 2004055624 | 7/2004 |
| WO | WO 2004063088 | 7/2004 |
| WO | WO 2004082436 | 9/2004 |
| WO | WO 2004089682 | 10/2004 |
| WO | WO 2004100829 | 11/2004 |
| WO | WO 2004108383 | 12/2004 |
| WO | WO 2005003205 | 1/2005 |
| WO | WO 2005003206 | 1/2005 |
| WO | WO 2005031111 | 4/2005 |
| WO | WO 2005042611 | 5/2005 |
| WO | WO 2005046988 | 5/2005 |
| WO | WO 2005065245 | 7/2005 |
| WO | WO 2005089297 | 9/2005 |

OTHER PUBLICATIONS

"Sleep Buddy™ Plus," OrthoSupport™ *Sleep Buddy Plus*, http://www.orthosupport.com/OL1032.htm, OrthoSupport International Co, 2000, 3 pages.

*Supple-Pedic* pillow, Strobel Technolgies, "Pillow Park Plaza," http://www.pillowpark.com/mat.asp, p. 2 (printed Jun. 27, 2000).

*Isotonic* pillow, Carpenter Co., http://www.carpenter.com/consumer/isotonic.htm, p. 1 (printed Jun. 27, 2000).

*BackSaver* All Position Pillow, BackSaver, Backsaver.com 2000, . . . /pg_product_detail.cfm?TID=232405071376360027068379&CFID=96050713&CFTOK, p. 1 (printed Jun. 27, 2000).

Bay Jacobsen *ViscoFlex, CombiFlex*, Standard, Back Support, and Anatomical Sitting Wedge pillows, http://www.bayjacobsen.dk/content.asp?id=33, pp. 3 and 4 (printed Jun. 27, 2000).

"Advanced Comfort abed.com Pillows and Accessories," Advanced Comfort Mattresses, http://www.abed.com/cpillow.htm, p. 1 (printed Jun. 27, 2000).

"Supple-Pedic Pillows and Cushions," Strobel Technologies, http://www.strobelcom/supplepillow.htm, pp. 1 and 2 (printed Jun. 27, 2000).

"Splintek *SleepRight* Side Sleeping Pillow," http://www.splintek.com/ph/chirocontour.html, 2005 Splintek PP-Inc., pp. 1-3 (printed Nov. 14, 2005).

Sinomax.com.hk Home page, including picture of SINOMAX® My Beauty Pillow, http://www.sinomax.com.hk/en/home.html, 2003 Sinomax (Holding) Group Ltd., p. 1 (printed Dec. 13, 2004).

Sinomax.com.hk "About Us" link, narrative for SINOMAX® Sinomax (Holding) Group "TV-228 My Beauty Pillow," http://www.sinomax.com.hk/en/oem/product/bedroom/pillow/detail.html?id=2337, 2003 Sinomax (Holding) Group Ltd., p. 1 (printed Dec. 13, 2004).

Sinomax.com.hk "Export" page, narrative for SINOMAX® Sinomax (Holding) Group "Export—New & Hot Products," including, among other things, pillows and cushions, http://www.sinomax.com.hk.en.oem.overview.html, 2003 Sinomax (Holding) Group Ltd., pp. 1-3 (printed Dec. 13, 2004).

* cited by examiner

PILLOW AND METHOD OF MANUFACTURING A PILLOW

BACKGROUND OF THE INVENTION

The neck of a person lying in a supine or sidelying position is often out of alignment with the person's spine. This is commonly the case when the person's neck is supported by a pillow or multiple pillows such that the neck lies at an angle defined by the deflected height of the pillow(s), and this angle is typically not co-planar with the spine. The deflected height of the pillow is closely related to its stiffness, which is conventionally provided with filling material disposed within a fabric covering. Conventional filling material can include feathers, cotton, or a synthetic filler.

SUMMARY OF THE INVENTION

To provide a pillow structure more likely to properly align the user's neck and spine, some embodiments of the invention provides a pillow having multiple foam components.

Some embodiments of the present invention include a pillow having a viscoelastic sleeve defining a cavity and filler material positioned within the cavity.

In some embodiments, a pillow is provided, and comprises a sleeve comprising visoelastic material and defining an internal cavity; and a plurality of loose pieces of filler material substantially enclosed within the cavity.

Also, some embodiments of the present invention include a pillow having outer layers and a filler material comprised of granulated viscoelastic foam disposed between the outer layers.

Some embodiments of the present invention includes a pillow having outer layers of reinforcing fabric, intermediate layers of viscoelastic foam, and a filler material comprised of granulated viscoelastic foam disposed between the intermediate layers.

In some embodiments, a pillow is provided, and comprises a first layer of viscoelastic material; and a second layer of viscoelastic material, the first and second layers of viscoelastic material coupled together to form a cavity therebetween; wherein a plurality of loose pieces of filler material is positioned between the first and second viscoelastic layers and is substantially enclosed within the cavity.

The present invention also includes methods of manufacturing a pillow. In some embodiments, a method of manufacturing a pillow includes providing a viscoelastic sleeve that defines a cavity, inserting filler material within the cavity, and closing the sleeve to maintain the filler material within the cavity.

Some embodiments of the present invention provide a method of manufacturing a pillow, comprising coupling a first peripheral edge of a first panel of viscoelastic material to a second peripheral edge of a second panel of viscoelastic material; and enclosing a plurality of loose pieces of filler material between and within the first and second panels of viscoelastic material.

The viscoelastic foam responds to changes in temperature such that body heat molds the pillow to conform to the curves of a body for comfort and support. This allows the shape of the pillow to more closely follow the contours of the body, and in some embodiments can promote an improved alignment of the neck and spine when a person is in a supine or sidelying position.

A cover preferably encases the pillow and contours to the shape of the pillow. The cover is removable, washable, and has a resealable slot through which the pillow may be inserted or removed. The slot extends across an edge portion of the pillow and is preferably opened and closed by a zipper.

Figure 1:
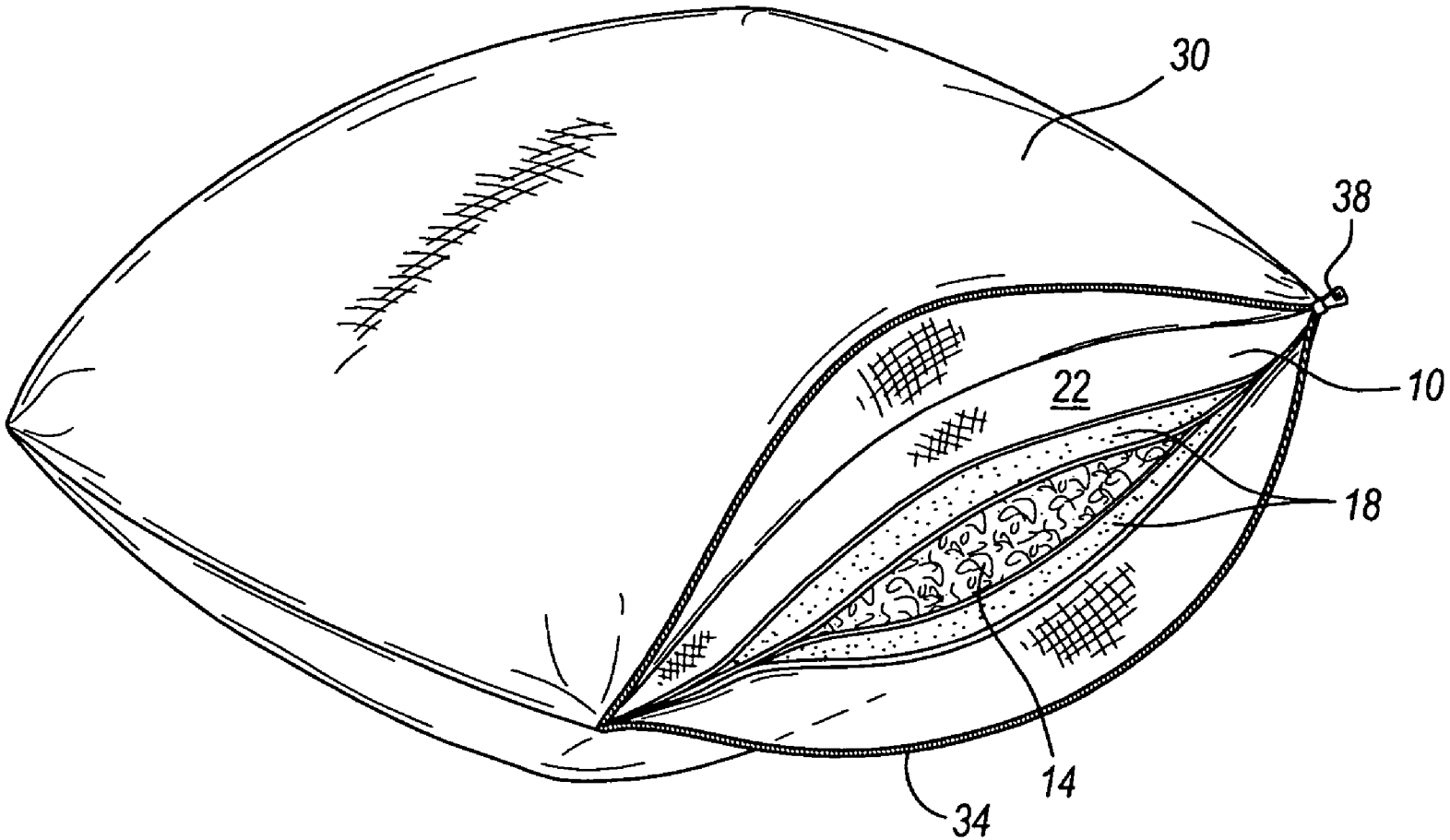
FIG. 1 is a perspective view of a pillow according to an embodiment of the present invention, shown with a resealable cover fastener in an opened position and with an end opened to illustrate internal components of the pillow.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 2:
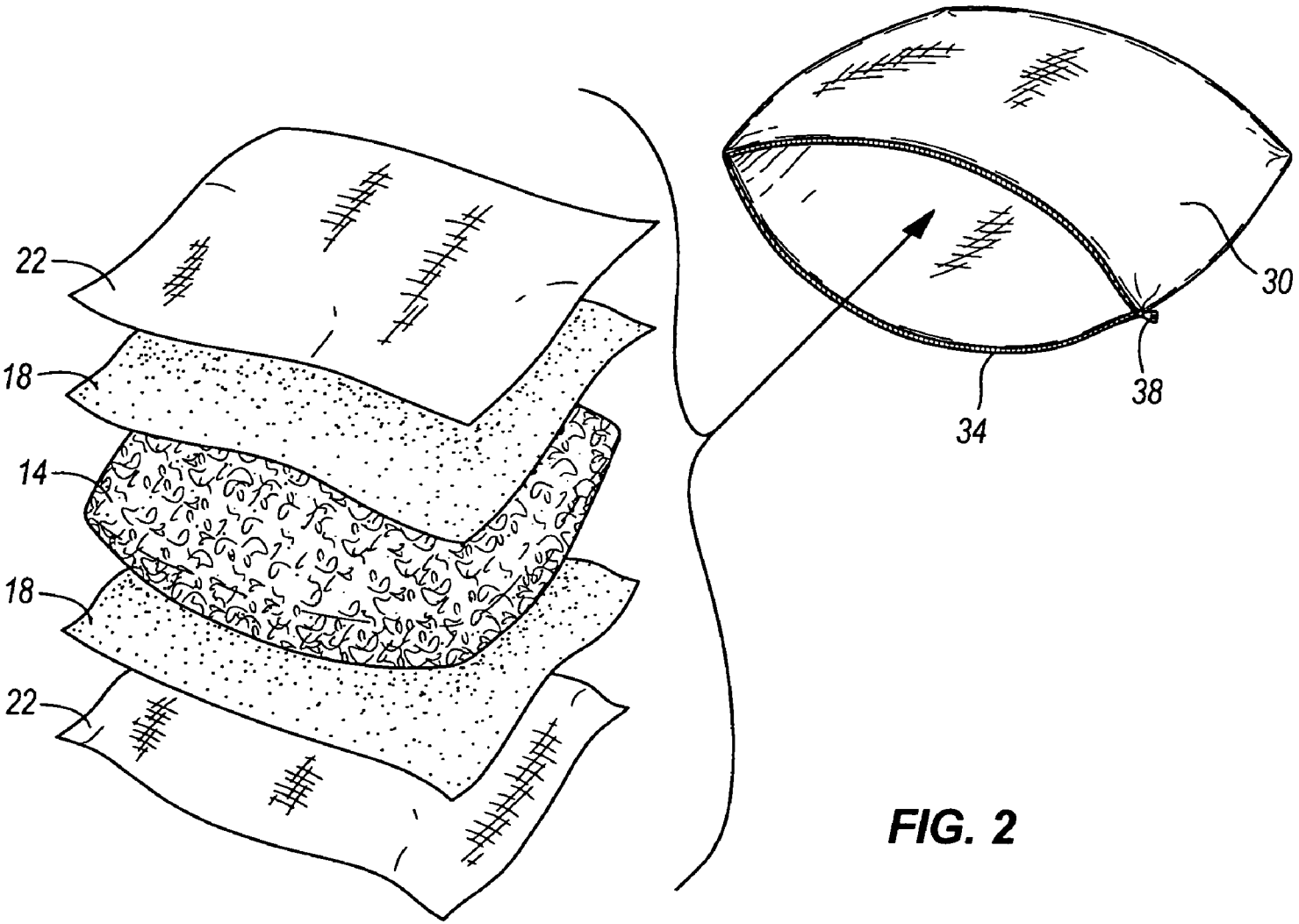
FIG. 2 is an exploded view of the pillow shown in FIG. 1.
Figure 3:
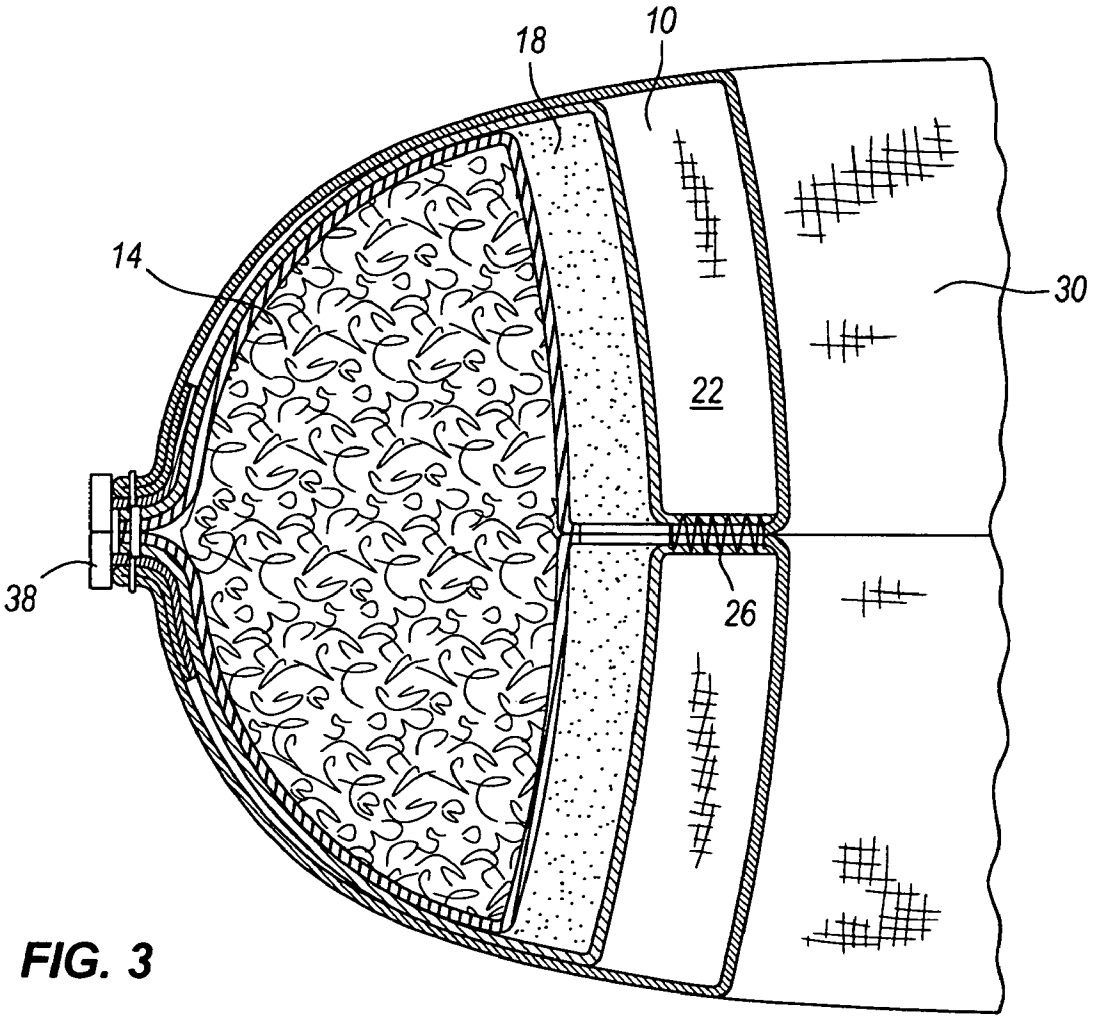
FIG. 3 is a partial cross-sectional view of the pillow shown in FIG. 1.

FIGS. 1-3 illustrate a pillow 10 of the present invention having a sleeve construction formed of multiple layers. The pillow 10 illustrated in FIGS. 1-3 has the generally rectangular shape of a standard pillow. However, it will be appreciated that the pillow 10 can have any other shape desired, including without limitation those that are round, oval, rod, crescent, U-shaped, Y-shaped, L-shaped, star, irregular, and the like. The pillow 10 comprises a filler material 14 disposed between layers of viscoelastic foam 18. The viscoelastic foam layers 18 can possess specific thermally responsive properties which cause the pillow 10 to conform to the shape of the portion of a person's body that contacts the pillow 10. The viscoelastic foam layers 18 can have a lower stiffness or hardness at an elevated temperature as compared to the stiffness at a cooler temperature. The body heat of the person acts to soften the portion of the pillow 10 in contact with the body, while the portion of the pillow 10 not contacting the body remains more firm. As a result, the pillow 10 illustrated in FIGS. 1-3 can allow for greater comfort over a conventional pillow by accommodating each user's body form.

In some embodiments of the present invention, the filler material 14 is granulated, or shredded, viscoelastic foam having a density of about 85 kg/m$^3$. However, a suitable density for the viscoelastic foam filler material 14 for an average weight pillow 10, for example, can be between about 30 and about 140 kg/m$^3$. Further, a suitable density for the viscoelastic foam filler material 14 for a light-weight pillow 10, for example, can be less than about 40 kg/m$^3$. Likewise, a suitable density for the viscoelastic foam filler material 14 for a heavy-weight pillow 10, for example, can be greater than about 130 kg/m$^3$. Alternatively, the granulated visoelastic foam utilized as the filler material 14 can have any density in accordance with the desired characteristics of the pillow 10. In addition, a suitable viscoelastic foam filler material 14 possesses an indentation load deflection, or "ILD," of 65% between 100-500 N loading, and a maximum 10% rebound according to the test procedure governed by the ASTM-D-1564 standard.

The granulated viscoelastic foam of the filler material 14 in the embodiment of FIGS. 1-3 is non-reticulated viscoelastic foam. However, in other embodiments, the viscoelastic foam of the filler material 14 can be or include reticulated viscoelastic foam. The cells of reticulated foam are essentially skeletal structures in which many (if not substantially all) of the cell walls separating one cell from another do not exist. In other words, the cells are defined by a plurality of supports or "windows", and by no cell walls, substantially no cell walls, or by a substantially reduced number of cell walls. A foam can be considered "reticulated" if at least 50% of the walls defining the cells of the foam do not exist (i.e., have been removed or were never allowed to form during the manufacturing process of the foam). The granulated viscoelastic foam of the filler material 14 can be 100% reticulated viscoelastic foam, 100% non-reticulated viscoelastic foam, or can include any relative amounts of reticulated and non-reticulated viscoelastic foams desired.

The granulated filler material 14 can be made up of recycled, virgin, or scrap viscoelastic material. As will be appreciated by one of ordinary skill in the art, the granulated filler material 14 can be produced in any manner desired, including without limitation by shredding, cutting, grinding, chopping, tearing, or ripping virgin, recycled, or scrap viscoelastic material, by molding or casting individual pieces, or in any other suitable manner. The granulated filler material 14 may consist of pieces of a nominal length, or the granulated filler material 14 may consist of pieces of varying length. For example, granulated filler material 14 may have a nominal length of about 1.3 cm. Also, granulated filler material 14 may consist of varying lengths between about 0.6 cm and about 2 cm. The granulated filler material 14 can be as short at 0.3 cm and as long as 4 cm., or the filler material 14 can be any length in accordance with the desired characteristics of the pillow 10. In some embodiments, the granulated filler material 14 is comprised of 16-20% having a length longer than 2 cm, 38-42% having a length between 1 and 2 cm, and 38-42% of the pieces shorter than 1 cm. Significant cost savings and waste reduction can be realized by using scrap or recycled filler material 14 rather than virgin filler material 14. Viscoelastic foam used as the filler material 14 can be made from a polyurethane foam material, however, the filler material 14 can be made from any other viscoelastic polymer material that exhibits similar thermally-responsive properties.

The composition of the filler material 14 can be varied to alter the characteristics of the pillow 10 and the cost of the pillow 10. In some embodiments of the present invention, the filler material 14 is a combination of granulated viscoelastic foam and a fiber material. The fiber material can be made from any kind of textile, such as an organic textile (cotton) or a synthetic textile. In some embodiments of the present invention, the fiber material has a density of about 1 g/cm$^3$. However, a suitable density for the fiber material for an average weight pillow 10, for example, is 0.1-2 g/cm$^3$. Further, a suitable density for the fiber material for a light-weight pillow 10, for example, can be less than about 0.3 g/cm$^3$. Likewise, a suitable density for the fiber material for a heavy-weight pillow 10, for example, can be greater than about 1.8 g/cm$^3$. Alternatively, the fiber material utilized in combination with the granulated viscoelastic foam as the filler material 14 can have any density in accordance with the desired characteristics of the pillow 10.

In some embodiments, the filler material 14 is comprised of about 50% fiber material, while the remaining composition includes granulated viscoelastic foam. However, a suitable range of fiber material in the filler material 14 for some pillows 10, for example, can be between about 20% and about 80%. Further, a suitable range of fiber material in the filler material 14 for other pillows 10, for example, can be less than about 30% of the filler material 14. Likewise, a suitable range of fiber material in the filler material 14 for still other pillows 10, for example, can be greater than about 70% of the filler material 14.

In some embodiments, the filler material 14 is a combination of granulated viscoelastic foam and polystyrene balls. The filler material 14 can also or instead include an organic or synthetic fiber material depending on the desired characteristics of the pillow 10. The polystyrene balls may consist of balls of a nominal diameter, or the polystyrene balls may consist of balls of varying diameters. For example, the polystyrene balls may have a nominal diameter of about 5 mm. Also, the polystyrene balls may consist of varying diameters between about 1 mm and about 10 mm. The polystyrene balls can also be as small as 0.5 mm and as large as 20 mm, or the polystyrene balls can have any size in accordance with the desired characteristics of the pillow 10.

The filler material 14 in some embodiments comprises about 50% polystyrene balls, while the remaining composition includes granulated viscoelastic foam. However, a suitable range of polystyrene balls in the filler material 14 for some pillows 10, for example, can be between about 20% and about 80%. Further, a suitable range of polystyrene balls in the filler material 14 for other pillows 10, for example, can be less than about 30% of the filler material 14. Likewise, a suitable range of polystyrene balls in the filler material 14 for still other pillows 10, for example, can be greater than about 70% of the filler material 14.

In some embodiments, the filler material 14 can include granulated highly-elastic ("HE") foam in addition to granulated viscoelastic foam. Such HE foam can take any of the granulated forms described above with reference to the granulated viscoelastic foam. Furthermore, the filler material 14 can include still other materials, such as feathers, down, granulated cotton, cotton fibers, wool, beads, beans, latex, other types of foam (in any of the granulated forms described above), and the like. The filler material 14 can be comprised of any single filler described herein or any combination of such fillers. In some embodiments, for example, the filler material 14 includes HE foam having a density of about 35 kg/m$^3$. However, a suitable density for the HE foam for an average weight pillow 10, for example, can be between about 20 kg/m$^3$ and about 50 kg/m$^3$. Further, a suitable density for the HE foam for a lightweight pillow 10, for example, can be less than about 25 kg/m$^3$. Likewise, a suitable density for the HE foam for a heavyweight pillow 10, for example, can be greater than about 45 kg/m$^3$. Alternatively, the HE foam utilized in the filler material 14 can have any density in accordance with the desired characteristics of the pillow 10.

If used, the granulated HE foam (or other types of granulated non-viscoelastic foam, as described above) may consist of pieces of a nominal length, or the granulated HE foam may consist of pieces of varying lengths. For example, the granulated HE foam may have a nominal length of about 1.3 cm. Also, the granulated HE foam may consist of varying lengths between about 0.6 cm and about 2 cm. The granulated HE foam can be as short as 0.3 cm and as long as 4 cm., or the granulated HE foam can be any length in accordance with the desired characteristics of the pillow 10. In some embodiments, the granulated HE foam is comprised of 16-20% having a length longer than 2 cm, 38-42% having a length between 1 and 2 cm, and 38-42% of the pieces being shorter than 1 cm. Such foam lengths can also be utilized for other granulated non-viscoelastic foams.

In some embodiments, the filler material 14 comprises about 50% granulated HE foam (or other granulated non-viscoelastic foam, as described above), while the remaining composition includes the granulated viscoelastic foam. However, a suitable range of HE foam in the filler material 14 for some pillows 10, for example, is 20%-80%. Further, a suitable range of granulated HE foam in the filler material 14 for other pillows 10, for example, can be less than about 30% of the filler material 14. Likewise, a suitable range of granulated HE foam in the filler material 14 for still other pillows 10, for example, can be greater than about 70% of the filler material 14. Such foam amounts can also be utilized for other granulated non-viscoelastic foams.

As previously mentioned, the filler material 14 in the illustrated embodiment of FIGS. 1-3 is disposed between layers 18 of viscoelastic foam. It should be noted that the layers 18 of viscoelastic foam described herein can be defined by two separate pieces of viscoelastic foam, or a single piece of viscoelastic foam folded upon itself. Alternatively, the layers 18 of viscoelastic foam can be defined by three or more pieces of viscoelastic foam connected in any suitable manner (e.g., stitching, gluing, melting, and the like) to define a sleeve within which the filler material 14 is enclosed and retained.

In some embodiments, the layers of viscoelastic foam 18 have a density of about 85 kg/m$^3$. However, a suitable density for the layers of viscoelastic foam 18 for an average weight pillow 10, for example, can be between about 30 and about 140 kg/m$^3$. Further, a suitable density for the layers of viscoelastic foam 18 for a lightweight pillow 10, for example, can be less than about 40 kg/m$^3$. Likewise, a suitable density for the layers of viscoelastic foam 18 for a heavyweight pillow 10, for example, can be greater than about 130 kg/m$^3$. Alternatively, the layers of viscoelastic foam 18 can have any density in accordance with the desired characteristics of the pillow 10.

The viscoelastic foam of the layers 18 illustrated in FIGS. 1-3 is non-reticulated viscoelastic foam. However, in other embodiments, the viscoelastic foam 18 of either or both layers 18 can comprise reticulated viscoelastic foam (described in greater detail above with reference to the granulated viscoelastic foam filler material 14).

The layers of viscoelastic foam 18 can be about 10 mm thick and have thermally-responsive properties similar to the granulated viscoelastic foam of the filler material 14. Likewise, a suitable thickness for the layers of viscoelastic foam 18 for an average weight pillow 10, for example, can be between about 5 mm and 15 mm. However, a suitable thickness for the layers of viscoelastic foam 18 for a heavyweight pillow 10, for example, can be greater than about 13 mm. The layers of viscoelastic foam 18 can be made from a polyurethane foam material. However, the layers of viscoelastic foam 18 can be made from any other viscoelastic polymer material that exhibits similar thermally-responsive properties.

In some embodiments, the layers 18 can comprise any other type of sheet material desired, including without limitation cloth or fabric in woven or non-woven form, webbing, netting, velour, felt, and the like comprised of cotton, wool, synthetic materials (e.g., polyester or polyester blends), reticulated and/or non-reticulated non-viscoelastic foam, silk, satin, and the like.

The overall stiffness or hardness of the pillow 10 is dependent at least in part upon the stiffness of the individual viscoelastic foam layers 18 and the filler material 14. As such, the overall stiffness or hardness of the pillow 10 may be affected by varying the stiffness of the individual viscoelastic foam layers 18 and/or the filler material 14.

As shown in FIGS. 1-3, reinforcing layers 22 are positioned on the outside of the layers of viscoelastic foam 18. The reinforcing layers 22 can comprise fabric, and can act as an anchor for stitches 26 that secure together the layers of reinforcing layers 22 and the layers of viscoelastic foam 18. Without the reinforcing layers 22, the viscoelastic foam layers 18, which can be less durable than the reinforcing layers 22, would have to directly anchor the stitches 26 such that the filler material 14 is secured between the viscoelastic foam layers 18. In a pillow having this construction (not shown) and depending upon the type of foam employed for the layers 18, the viscoelastic foam layers 18 could be more likely to tear near the stitches 26 as a result of normal use of the pillow. Therefore, reinforcing layers 22 can provide a measure of durability to the pillow 10. The reinforcing layers 22 can be made from a durable material, such as a cotton/polyester blend, or any of the non-viscoelastic sheet materials described above in connection with the layers 18.

Although only two reinforcing layers 22 are illustrated in the embodiment of FIGS. 1-3 (positioned on external surfaces of the viscoelastic foam layers 18), it should be noted that additional reinforcing layers 22 can be positioned on internal surfaces of either or both viscoelastic foam layers 18. Depending at least in part upon the construction of the pillow (e.g., in those embodiments in which the edges of the viscoelastic foam layers 18 are turned inward and are stitched together along the inwardly-turned edges), reinforcing layer(s) 22 adjacent internal surfaces of either or both viscoelastic foam layers 18 can be utilized in addition to or instead of reinforcing layers 22 on the external surfaces of either or both viscoelastic foam layers 18. Such internal reinforcing layers 22 can be utilized to cover internal surfaces of the viscoelastic foam layers 18, and need not necessarily perform a reinforcing function for the stitches 26 at all. In some embodiments, either or both viscoelastic foam layers 18 are substantially encased by reinforcing layers 22 on both faces of the layer(s) 18.

A cover 30 surrounds and encases the pillow 10 illustrated in FIGS. 1-3, and can conform to the shape of the pillow 10. The cover 30 can be made from a durable and washable fabric material, such as a cotton/polyester blend. Alternatively, the cover 30 can be made from any other type of sheet material desired, including without limitation cloth or fabric in woven or non-woven form, webbing, netting, velour, felt, and the like comprised of cotton, wool, synthetic materials (e.g., polyester or polyester blends), silk, satin, and the like.

As shown in FIG. 1, a slot 34 extends across the illustrated cover 30 along the cover's edge. The pillow 10 may be inserted into the cover 30 through the slot 34. The pillow 10 may also be removed from the cover 30 through the slot 34 to facilitate cleaning of the cover 30. The slot 34 can be resealable to close the cover 30 around the pillow 10 and to open the cover 30 for removing the pillow 10. A closure device can be used to open and close the slot 34. In some embodiments, the closure device is a zipper 38, although the closure device could also or instead include snaps, buttons, clasps, pieces of hook and loop fastener material, hook and eyelet sets, overlapping flaps, laces, tied ribbons, strings, cords, and the like manufacture, the layers of viscoelastic foam 18 in the illustrated embodiment of FIGS. 1-3 can be sewn together with the reinforcing layers 22 to form a sleeve or casing having an open end, wherein the layers of viscoelastic foam 18 comprise the inner layers of the casing and the reinforcing layers 22 comprise the outer layers of the casing. The filler material 14 can then be inserted through the open end of the casing until a desired amount of filler material 14 is reached within the casing. The open end can then be sewn closed, thereby encasing the filler material 14 within the casing and defining a pillow 10. In other embodiments, the filler material 14 can be positioned adjacent or upon either or both layers of viscoelastic foam 18, which can then be moved to enclose the filler material 14 and can thereafter be sealed (e.g., sewn, melted, and the like) together to form the sleeve or casing. The pillow 10 can then be inserted within the cover 30 and the cover 30 closed by the zipper 38.

Figure 4:
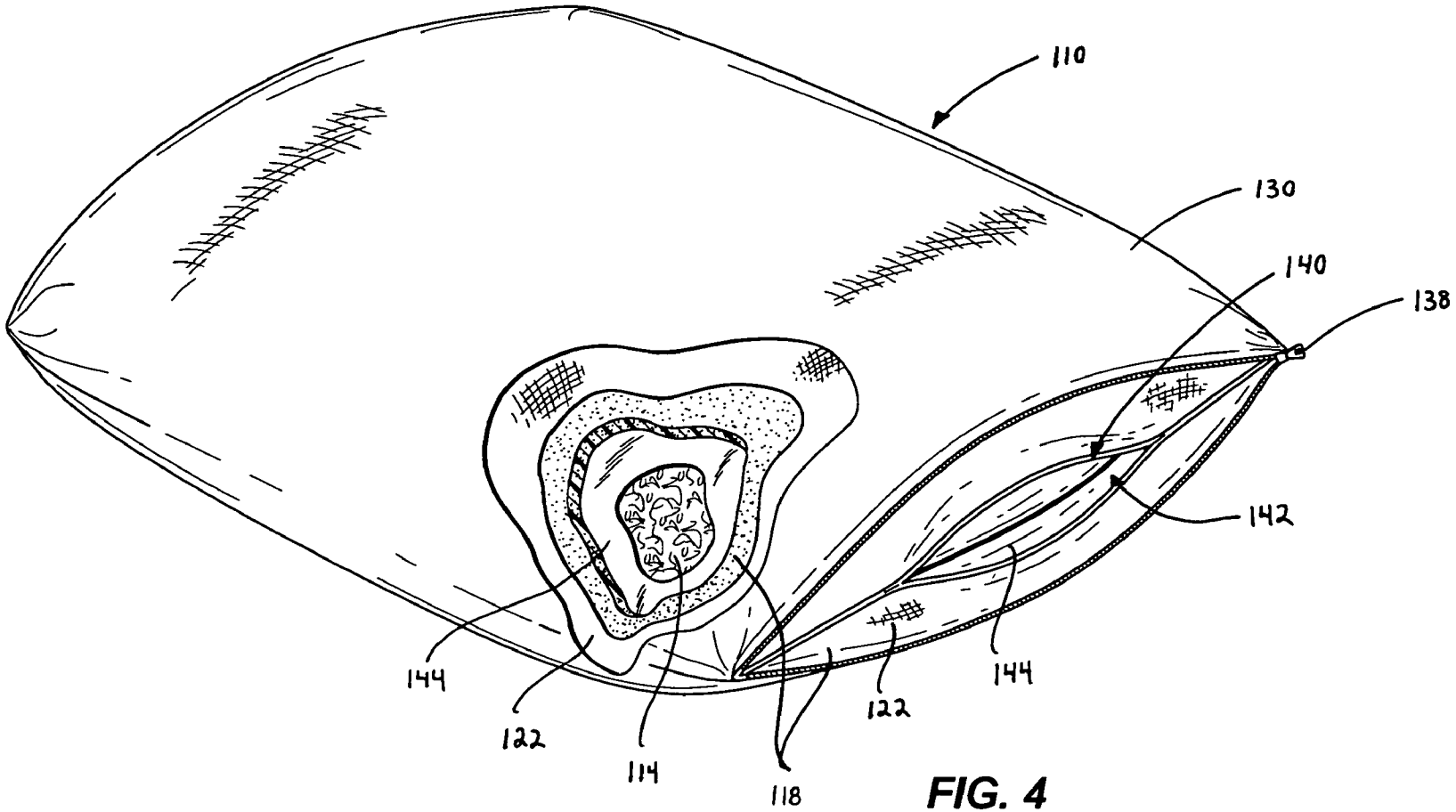
FIG. 4 is a partially sectioned perspective view of a pillow according to another embodiment of the present invention, shown with a resealable cover fastener in an opened postiion to illustrate internal components of the pillow.
Figure 5:
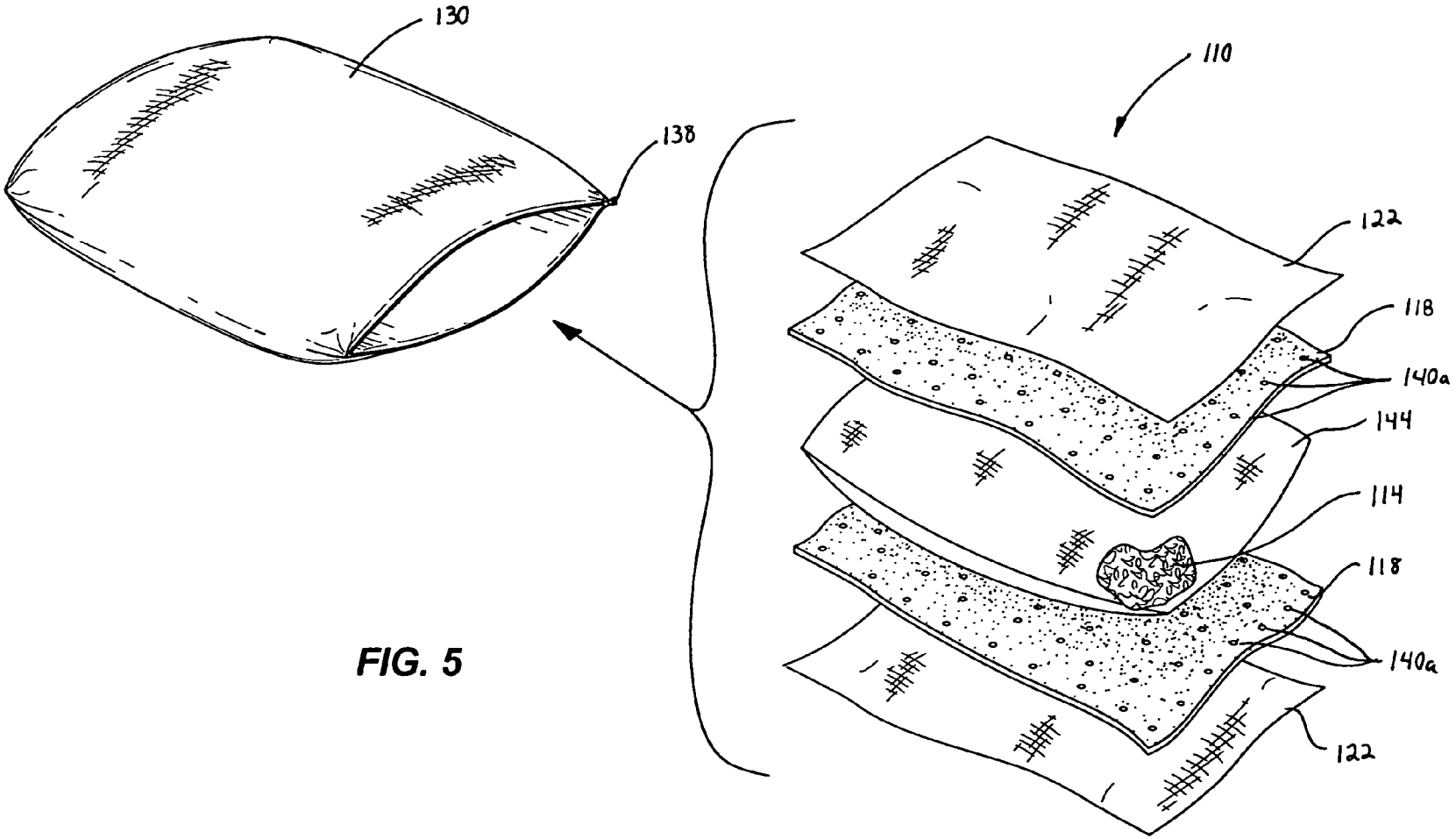
FIG. 5 is an exploded perspective view of the pillow shown in FIG. 4.

FIGS. 4 and 5 illustrate a pillow according to another embodiment of the present invention. The pillow illustrated in FIGS. 4 and 5 employs much of the same structure and has many of the same features and properties as the embodiments of the pillow described above in connection with FIGS. 1-3. Accordingly, the following description focuses primarily upon the pillow structure and features that are different than the pillow embodiments described above in connection with FIGS. 1-3. Reference should be made to the description above in connection with FIGS. 1-3 for additional information regarding the structure and features, and possible alternatives to the structure and features of the pillow illustrated in FIGS. 4 and 5 and described below. Structure and features of the embodiment shown in FIGS. 4 and 5 that correspond to structure and features of the embodiment of FIGS. 1-3 are designated hereinafter in the 100 series of reference numbers.

Like the pillow illustrated in FIGS. 1-3, the pillow 110 illustrated in FIGS. 4 and 5 has layers 118 of viscoelastic foam forming a sleeve and defining an internal cavity at least partially filled with filler material 114. The filler material 114 and layers 118 are described in greater detail above in connection with the embodiment illustrated in FIGS. 1-3, as are alternatives to the type, features, and characteristics of the filler material 114 and layers 118.

With continued reference to the pillow 110 illustrated in FIGS. 4 and 5, the pillow can have reinforcing layers 122 positioned on the exterior surfaces of the layers 118 of viscoelastic foam. The reinforcing layers 122 can have any of the same properties, be comprised of any of the same materials and perform any of the same functions as described above with reference to the pillow 10 illustrated in FIGS. 1-3. Also, the reinforcing layers 122 can instead be positioned on the interior surfaces of the layers 118 of viscoelastic foam. In some embodiments, the reinforcing layers 122 can be positioned on the interior and exterior surfaces of the layers 118 of viscoelastic foam. Furthermore, the reinforcing layers 122 can be positioned on selected areas of the layers 118 of viscoelastic foam. For example, the reinforcing layers 122 can be positioned only at the seams where the layers 118 of viscoelastic foam are attached.

The pillow 110 can have a cover 130 which surrounds and encases the pillow 110, and which can conform to the shape of the pillow 110. The cover 130 can have any of the same properties, be comprised of any of the same materials, and perform any of the same functions as described above with reference to the pillow 10 illustrated in FIGS. 1-3. Also, the cover 130 illustrated in FIGS. 4 and 5 is provided with a zipper 138 described above in connection with FIGS. 1-3, although any of the other types of closure device also described above can instead be used. Alternatively, the cover 130 can be a sleeve with at least one end open for insertion of the pillow 110, but having no closure device.

The filler material 114 can comprise loose pieces of material having any of the same properties, comprising any of the same materials (and combinations of materials), and performing any of the same functions described above with reference to the illustrated embodiment of FIGS. 1-3.

The layers 118 of viscoelastic foam illustrated in FIGS. 4 and 5 form a sleeve, and can have any of the same properties, be comprised of any of the same materials, and perform any of the same functions as described above with reference to the pillow 110 illustrated in FIGS. 1-3.

The layers 118 of viscoelastic foam illustrated in FIGS. 4 and 5 are connected together along their respective peripheries to define openings 140 at the sides of the pillow 110 (only one of which is visible in FIG. 4, the other being located on the opposite side of the pillow 110). The openings 140 in the embodiment of FIGS. 4 and 5 are defined by leaving portions of the peripheral edges of the layers 118 unconnected to one another. Alternatively, the openings 140 can be created by cutting openings 140 in or between the layers 118, or by forming the openings in any other suitable manner.

As described above, openings 140 are defined at opposite ends of the pillow 110 between the layers 118 of viscoelastic foam illustrated in FIGS. 4 and 5. These openings permit airflow between a cavity 142 defined between the layers 118 and the exterior of the layers 118, thereby providing enhanced ventilation for the pillow 110 and/or permitting air to enter or leave the cavity 142 more rapidly during shape change of the pillow 110 (e.g., when a user's head or body compresses the pillow, when the pillow is "fluffed", and the like).

Although two relatively large openings 140 in the illustrated embodiments of FIGS. 4 and 5 are located at opposite ends of the pillow 110, any number of openings 140 can be in any other locations in or between the layers 118, and on any single side of the pillow 110 or combination of sides of the pillow 110. For example, a single opening 140 can be defined between an unconnected portion of the layers 118 at the front or rear of the pillow 110, at a lateral side of the pillow 110 (such as the location of the visible opening 140 shown in FIG. 4), or at a corner of the pillow 110. As another example, one or more openings 140 can be located in the body of either or both layers 118. As yet another example, several openings 140 can be defined between unconnected portions of the layers 118 on the same side of the pillow 110. Still other numbers and locations of openings 140 are possible, and fall within the spirit and scope of the present invention.

The openings 140 in the illustrated embodiment of FIGS. 1-3 are substantially elongated, and take the form of slits extending along opposite sides of the pillow 110 as described above. In other embodiments, however, the openings 140 have any other shape desired, including without limitation round, rectangular, oval, and irregularly-shaped openings 140.

In some embodiments, the openings 140 are utilized only for purposes of ventilation as described above, and can therefore be sufficiently small while still performing this function. For example, a number of relatively small openings **140*a* are defined in both layers 118 of viscoelastic material illustrated in FIGS. 4 and 5 (see FIG. 5). However, in other embodiments, the openings 140 are utilized for enabling a user to insert filler material 114 into the cavity 142 and/or to remove filler material 114 from the cavity 142. Such openings 140 can also be sufficiently large to insert and remove an inner sleeve 144 at least partially filled with filler material 114 as will be described in greater detail below. For example, the openings 140 in the illustrated embodiment extend along a substantial portion of the sides of the pillow 110**, and in some embodiments can extend along a majority of the length of such sides.

In still other embodiments, one or more openings can extend along substantially an entire side of the pillow 110. As another example, one or more openings (e.g., slits) can be defined in a top side and/or bottom side of the pillow 110, such as in the body of either or both layers 118 of viscoelastic foam. Such openings 140 can be sufficiently large for a user to insert and remove an inner sleeve 144 at least partially filled with filler material 114 as will be described in greater detail below.

In some embodiments, any or all of the larger openings 140 used for insertion and removal of an inner sleeve 144 with filler material 114 (as described above) can be provided respective closure devices (not shown) to open and close such openings. The closure device(s) can take any of the forms described above with reference to the closure device 138 of the cover 130.

As mentioned above, filler material 114 can be located within an inner sleeve 144 between and enclosed within the layers 118 of viscoelastic foam. Although filler material 114 can be located both within the inner sleeve 144 and between the inner sleeve 144 and either or both layers 118 of viscoelastic foam, the filler material 114 in FIGS. 4 and 5 is located only within the inner sleeve 144. The inner sleeve 144 and filler material 114 therein can take the form of a traditional pillow received between the layers 118 of viscoelastic foam. For example, the inner sleeve 144 and filler material 114 therein can be a down or feather pillow, can be a conventional pillow having any type of fill (e.g., cotton, balls, beads, beans, or foam), and the like. In some embodiments, such a pillow can be selected by a user and inserted through an opening 140 between the layers 118 of viscoelastic foam or in a layer 118 of the viscoelastic foam, thereby constructing a pillow 110 having desired characteristics.

The inner sleeve 144 can comprise any traditional pillow covering material, including without limitation cloth or fabric in woven or non-woven form, webbing, netting, velour, felt, and the like comprised of cotton, wool, synthetic materials (e.g., polyester or polyester blends), silk, satin, and the like. In some embodiments, the inner sleeve 144 can be made of another layer of reticulated or non-reticulated viscoelastic material or another type of foam. The inner sleeve 144 can be constructed in any suitable manner, such as by being sewn together along seams. Also, the inner sleeve 144 can have a closure device on one or more sides to facilitate user access to the filler material 114 therein. The closure device (not shown) can take any of the forms described above with reference to the closure device 138 of the cover 130.

During manufacture of the pillow 110 illustrated in FIGS. 4 and 5, the layers 118 of viscoelastic foam 118 are sewn together with the reinforcing layers 122 to form a sleeve or casing having one or more openings 140 sufficiently large to receive the inner sleeve 144 and filler material 114 therein. Separately, the layers of the inner sleeve 144 are sewn or otherwise connected to form a sleeve in which the filler material 114 is retained. In some embodiments, the filler material 114 is enclosed within the inner sleeve by sewing and/or by closing a zipper or other closure device of the inner sleeve 144. The inner sleeve 144 with its filler material 114 is then inserted through an opening 140 and into the cavity 142 between the layers 118 of viscoelastic foam 118. If a closure device is provided for the opening, the closure device can then be closed. In the illustrated embodiment however, the opening 140 remains open so that the inner sleeve 144 is open to the environment. The pillow 110 can then be inserted into the cover 130, which in the illustrated embodiment of FIGS. 4 and 5 can be closed by the zipper 138. In other embodiments, the cover 130 can remain open.

Figure 6:
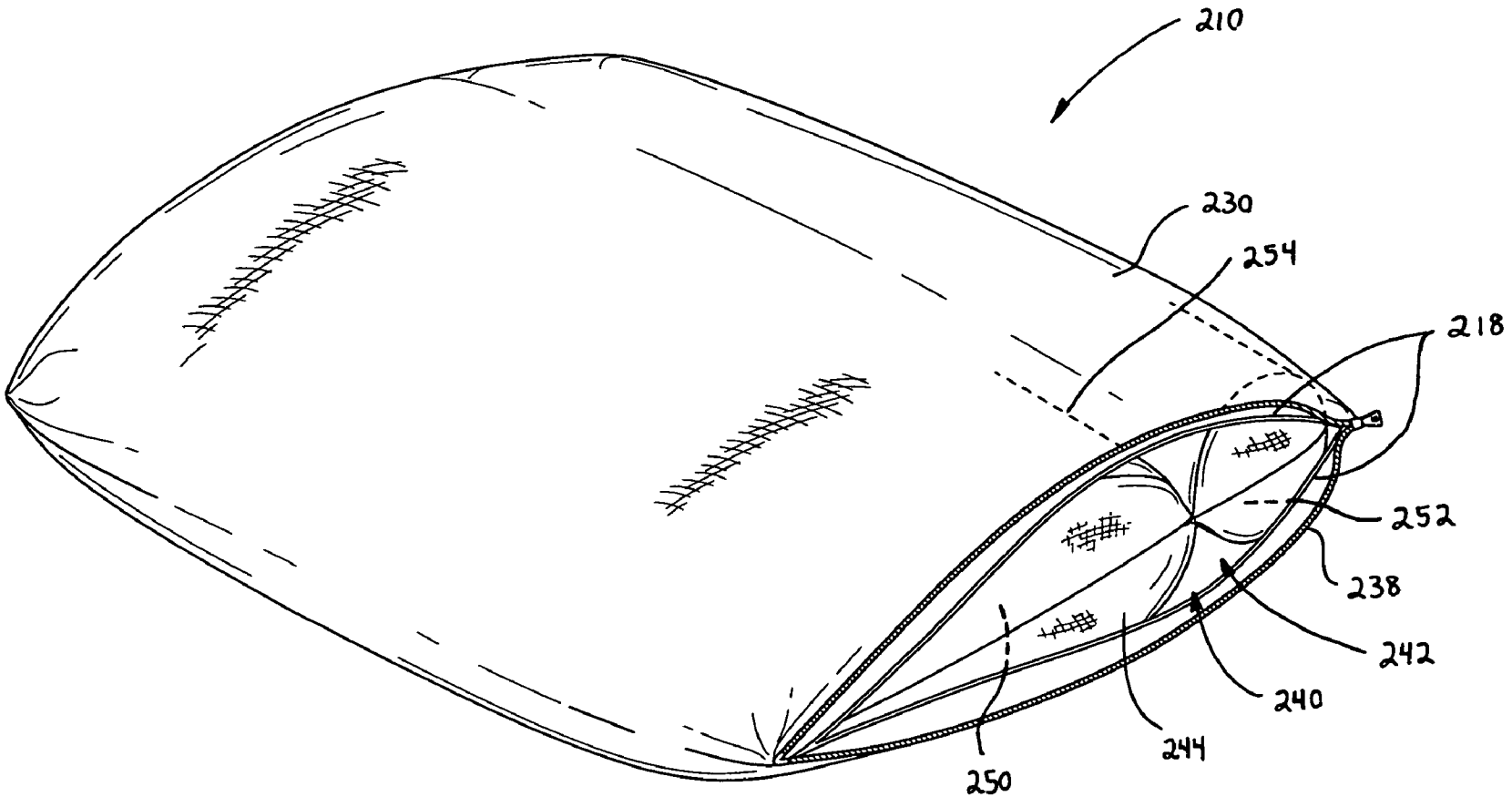
FIG. 6 is a perspective view of yet another pillow according to an embodiment of the present invention, shown with a resealable cover fastener in an opened position to illustrate internal components of the pillow.
Figure 7:
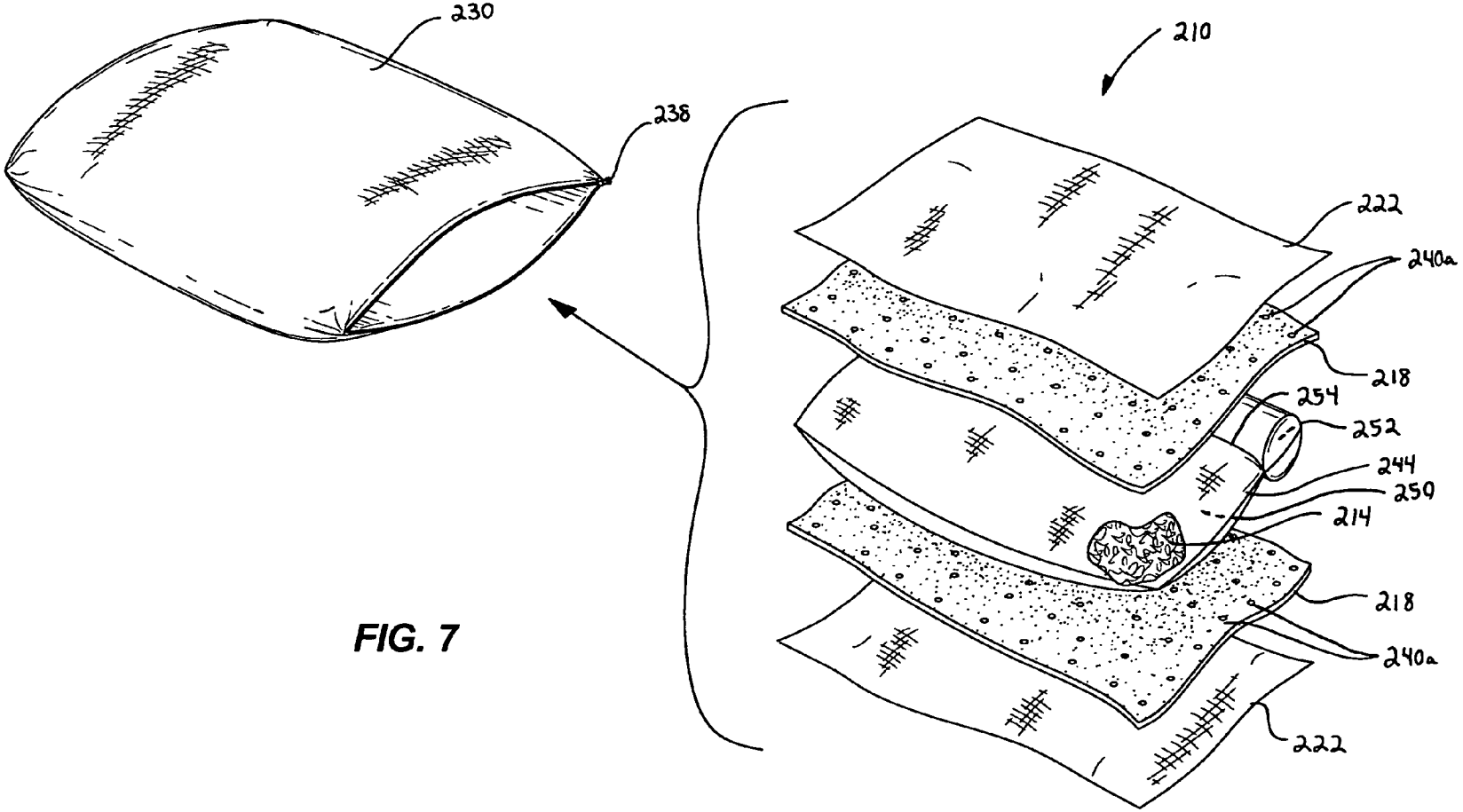
FIG. 7 is an exploded perspective view of the pillow shown in FIG. 6.

FIGS. 6 and 7 illustrate a pillow according to yet another embodiment of the present invention. The pillow illustrated in FIGS. 6 and 7 employs much of the same structure and has many of the same features and properties as the embodiments of the pillow described above in connection with FIGS. 4 and 5. Accordingly, the following description focuses primarily upon the pillow structure and features that are different than the pillow embodiments described above in connection with FIGS. 4 and 5. Reference should be made to the description above in connection with FIGS. 4 and 5 for additional information regarding the structure and features, and possible alternatives to the structure and features of the pillow illustrated in FIGS. 6 and 7 and described below. Structure and features of the embodiment shown in FIGS. 6 and 7 that correspond to structure and features of the embodiment of FIGS. 4 and 5 are designated hereinafter in the 200 series of reference numbers.

Like the pillow illustrated in FIGS. 4 and 5, the pillow 210 illustrated in FIGS. 6 and 7 has layers 218 of viscoelastic foam forming a sleeve and defining an internal cavity at least partially filled with filler material 214 (see FIG. 7). The filler material 214 and layers 218 are described in greater detail above in connection with the embodiments illustrated in FIGS. 1-3 and 4-5, as are alternatives to the type, features, and characteristics of the filler material 214 and layers 218.

The pillow 210 illustrated in FIGS. 6 and 7, can have reinforcing layers 222 (see FIG. 7) positioned on the exterior surfaces of the layers 218 of viscoelastic foam. The reinforcing layers 122 can be located in any of the positions, have any of the same properties, be comprised of any of the same materials and perform any of the same functions as described above with reference to the pillows 10, 110 illustrated in FIGS. 1-5.

The pillow 210 can have a cover 230 which surrounds and encases the pillow 210, and which can conform to the shape of the pillow 210. The cover 230 can also have any of the same properties, be comprised of any of the same materials, and perform any of the same functions as described above with reference to the pillows 10, 110 illustrated in FIGS. 1-5. Also, the cover 230 illustrated in FIGS. 6 and 7 is provided with a zipper 238 described above in connection with FIGS. 1-5, although any of the other types of closure device also described above can instead be used. Alternatively, the cover 230 can be a sleeve with at least one end open for insertion of the pillow 210, but having no closure device.

The filler material 214 can comprise loose pieces of material having any of the same properties, comprising any of the same materials (and combinations of materials), and performing any of the same functions described above with reference to the illustrated embodiments of FIGS. 1-5.

The layers 218 of viscoelastic foam illustrated in FIGS. 6 and 7 form a sleeve, and can have any of the same properties, be comprised of any of the same materials, and perform any of the same functions as described above with reference to the pillows 10, 110 illustrated in FIGS. 1-5.

Like the pillow 110 illustrated in FIGS. 4 and 5, the pillow 210 illustrated in FIGS. 6 and 7 has openings 240 (see FIG. 6) through which an inner sleeve 244 with filler material 214 therein can be inserted into and removed from a cavity 242 between the layers 218 of viscoelastic material. Although only one opening 240 is visible in FIG. 6, a similar opening 240 is located between the layers 218 of viscoelastic material on an opposite end of the pillow 210. Any number of openings 240 for the inner sleeve 244 and filler material 214 can be in any of the locations described above in connection with the illustrated embodiment of FIGS. 4 and 5, and can take any of the forms also described above. The opening 240 illustrated in FIG. 6 provides an example of a different opening size that can be employed for the pillow (when compared to FIG. 4), although it should be noted that any other opening size and shape suitable for insertion and removal of the inner sleeve 244 and filler material 214 can instead be used.

The openings 240 in the illustrated embodiment of FIGS. 4 and 5 can serve to permit user insertion and removal of the inner sleeve 244 with its filler material 214, as well as to provide ventilation of the pillow 210 as also described in greater detail above in connection with the illustrated embodiment of FIGS. 4 and 5. However, additional openings 240*a* serving primarily for ventilation purposes can also be defined in the layers 218 of viscoelastic material as best shown in FIG. 7, and can be in any of the locations and take any of the forms described above in connection with the illustrated embodiment of FIGS. 4 and 5.

The inner sleeve 244 of the pillow illustrated in FIGS. 6 and 7 can be partially or entirely filled with any of the filler materials described above in connection with the embodiment of FIGS. 4 and 5, and can be provided with a closure device as also described above. The inner sleeve 244 illustrated in FIGS. 6 and 7 differs from that of FIGS. 4 and 5 in that the inner sleeve has separate internal compartments 250, 252 within which the filler material 214 is located. The separate compartments 250, 252 of the illustrated pillow 210 can be defined at least in part by a seam 254 running along the inner sleeve 244, such as a stitch line or a line along which different portions of the inner sleeve 244 are connected in any other manner (e.g., by adhesive or cohesive bonding material, by hook and loop fastener material, by melting, by one or more fasteners, and the like). Alternatively, the separate compartments 250, 252 can be defined by different pieces of sheet material shaped to enclose respective amounts of filler material 214 and then connected together in any of the manners just described to arrive at the structure illustrated, The compartments 250, 252 of the illustrated pillow 210 have different sizes, and carry different amounts of filler material 214. However, this need not necessarily be the case, as compartments having the same size 250, 252 and containing the same amounts of filler material 214 are possible. In some embodiments, the compartments 250, 252 have different densities of filler material 214. For example, the density of filler material 214 in the first compartment 250 of the pillow 210 illustrated in FIGS. 6 and 7 is less than that of the second compartment 252. In this regard, the second compartment 252 is more completely filled than the first compartment 250, resulting in a corresponding portion of the pillow 210 that is firmer, stiffer, and/or more plump. Such a difference between compartments 250, 252 can provide a pillow adapted to support different parts of a user in different manners. By way of example only, the second compartment 252 in the illustrated embodiment of FIGS. 6 and 7 can provide greater support for a user's neck than the amount of support provided to the user's head by the first compartment 250 by virtue of the difference in filler densities described above. If less support is desired in the neck area than for the user's head, the filler density can be reversed in other embodiments.

The different compartments 250, 252 of the pillow 210 illustrated in FIGS. 6 and 7 can also provide a manner in which to retain different types and combinations of filler materials in different areas of the pillow 210. For example, the first compartment 250 of the pillow 210 illustrated in FIGS. 6 and 7 can retain down filling 214, whereas the second compartment 252 of the pillow 210 can retain granulated viscoelastic foam. As another example, the first compartment 250 of the pillow 210 illustrated in FIGS. 6 and 7 can retain a combination of viscoelastic and non-viscoelastic granulated foam, while the second compartment 252 of the pillow 210 can retain polystyrene balls and/or beads. The filler material(s) 214 in each of the compartments 250, 252 can therefore be selected based upon the desired support, weight, hardness, body-conforming, and other characteristics of the pillow 210 in that location of the pillow 210. Any filler or combination of fillers (described above) in any desired density can be received within each compartment for this purpose The ability to provide different pillow characteristics in different areas of the pillow 210 based upon the density and type of filler 214 included in different pillow compartments 250, 252 facilitates the design of a wide variety of pillows 210 adapted for different users, different types of use (e.g., side-sleeping versus prone or supine, cradled versus non-cradled, and the like), and different types of support. In this regard, the inner sleeve 244 can be provided with any number of different compartments located in any desired locations of the pillow 210—many of which will be determined at least in part by the shape of the pillow.

By way of example only, the pillow 210 can have three compartments: a central compartment flanked by two compartments similar in shape to the second compartment 252 illustrated in FIGS. 6 and 7. As another example, the pillow 210 can have separate compartments located along the same side of the pillow, such as for different support of a user's neck and shoulders. In other embodiments, the pillow 210 can have different compartments on all sides of the pillow 210 for defining a perimeter portion having different characteristics than a central portion. As another example, the pillow 210 can have different compartments on different sides of the pillow 210 for users sharing the same pillow 210. As yet another example, the pillow 210 can have different compartments beneath opposite faces of the pillow, such that a user can flip the pillow 210 over for different support characteristics. In still other embodiments, a rectangular or other elongated pillow can have different compartments located along the length thereof, such as for a body, neck, or cheek pillow providing different types of support at different positions along the pillow.

Depending upon the type of pillow and the purpose for which the pillow is adapted, it will be appreciated that the compartments 250, 252 can have a number of different shapes and sizes (in addition to being located in a variety of different positions as described above). The compartments can have any rectangular, triangular, or other polygonal shape, can be rod-shaped, round, or oval, can have an irregular shape, can be pie, wedge, U, V, or L-shaped, or can have any other shape desired. The compartment shape(s) selected for the pillow 210 can depend at least in part upon the shape of the pillow 210 and the intended use of the pillow. For example, a rod-shaped or other elongated compartment can be used as a border for the pillow 210, whereas an L or V-shaped compartment can be used as a corner of the pillow 210. Still other shapes and positions of the compartments 250, 252 are possible, and fall within the spirit and scope of the present invention.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A pillow comprising:

a first sleeve comprising viscoelastic material and defining an internal cavity; and a plurality of loose pieces of filler material substantially enclosed within the cavity and a second sleeve located within the first sleeve, wherein the first sleeve includes an opening on a side of the first sleeve and through which the loose pieces of filler material and the second sleeve are inserted within and removed from the cavity as a single unit by a user; the pillow having a first state in which the plurality of loose pieces of filler material and the second sleeve are located outside of the first sleeve as a single unit while the opening remains open; and a second state in which the plurality of loose pieces of filler material and the second sleeve are located inside the first sleeve as a single unit while the opening remains open.

2. The pillow of claim 1, further comprising a cover substantially enclosing the first sleeve.

3. The pillow of claim 2, wherein the cover comprises a resealable fastener through which access to the first sleeve is obtained.

4. The pillow of claim 1, wherein the first sleeve includes a ventilation opening on at least one side of the first sleeve.

5. The pillow of claim 1, wherein:

the first sleeve comprises first and second panels of viscoelastic material joined together at peripheral seams to define the internal cavity; and the opening is at least partially defined by an unjoined peripheral area of the first and second panels of viscoelastic material.

6. The pillow of claim 4, wherein:

the first sleeve comprises first and second panels of viscoelastic material joined together at peripheral seams to define the internal cavity; and the ventilation opening is at least partially defined by an unjoined peripheral area of the first and second panels of viscoelastic material.

7. The pillow of claim 1, wherein the first sleeve comprises a plurality of ventilation apertures extending through walls of the first sleeve.

8. The pillow of claim 1, wherein the first sleeve comprises first and second panels of viscoelastic material joined together at peripheral seams to define the internal cavity.

9. A method of adapting a pillow for a user, comprising:

coupling a first peripheral edge of a first panel of viscoelastic material to a second peripheral edge of a second panel of viscoelastic material to define a first sleeve;

leaving a portion of the first and second peripheral edges unjoined to define an opening in the first sleeve;

providing a second sleeve at least partially filled with a plurality of loose pieces of filler material;

inserting the second sleeve with the plurality of loose pieces of filler material as a single unit through the opening of the first sleeve; leaving the opening of the first sleeve open after inserting the second sleeve with the plurality of loose pieces of filler material through the opening of the first sleeve; and removing the second sleeve with the plurality of loose pieces of filler material through the opening of the first sleeve as a single unit.

10. The method of claim 9, wherein coupling the first peripheral edge to the second peripheral edge comprises coupling peripheral edges of a single piece of viscoelastic material.

11. The method of claim 9, further comprising leaving a portion of the first and second peripheral edges unjoined to define a ventilation opening for a cavity between the first and second panels.

12. The method of claim 9, wherein the plurality of loose pieces of filler material comprises granulated viscoelastic foam.

* * * * *